US010070239B2

(12) United States Patent
Romigh

(10) Patent No.: US 10,070,239 B2
(45) Date of Patent: Sep. 4, 2018

(54) EFFICIENT PERSONALIZATION OF HEAD-RELATED TRANSFER FUNCTIONS FOR IMPROVED VIRTUAL SPATIAL AUDIO

(71) Applicant: The United States of America as Represented by the Secretary of the Air Force, Washington, DC (US)

(72) Inventor: Griffin D. Romigh, Beavercreek, OH (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 0 days.

(21) Appl. No.: 15/434,818

(22) Filed: Feb. 16, 2017

(65) Prior Publication Data

US 2017/0164085 A1 Jun. 8, 2017

Related U.S. Application Data

(63) Continuation of application No. 14/560,792, filed on Dec. 4, 2014.

(60) Provisional application No. 61/911,641, filed on Dec. 4, 2013.

(51) Int. Cl.

| | |
|---|---|
| ***H04R 5/00*** | (2006.01) |
| ***H04S 1/00*** | (2006.01) |
| ***H04S 7/00*** | (2006.01) |

(52) U.S. Cl.

CPC ..... *H04S 1/002* (2013.01); *H04S 7/303* (2013.01); *H04S 2420/01* (2013.01); *H04S 2420/11* (2013.01)

(58) Field of Classification Search

None

See application file for complete search history.

(56) References Cited

U.S. PATENT DOCUMENTS

2015/0055783 A1* 2/2015 Luo ..... H04S 5/00 381/17

OTHER PUBLICATIONS

Shin, Ki Hoon, and Youngjin Parki. "Enhanced Vertical Perception through Head-Related Impulse Response Customization Based on Pinna Response Tuning in the Median Plane." IEICE Trans. Fundamentals 91 .A (2008).*

Zotkin, Dmitry, Ramani Duraiswami, and Larry Davis. "Customizable Auditory Displays." International Conference on Auditory Display (2002).*

United States Patent and Trademark Office, Non-Final Office Action in U.S. Appl. No. 14/560,792, dated Mar. 20, 2017, 5 pages total.

* cited by examiner

*Primary Examiner* — James Mooney

(74) *Attorney, Agent, or Firm* — AFMCLO/JAZ; Chastity Whitaker

(57) ABSTRACT

A Head-Related Transfer Function. The Head-Related Transfer Function includes listener-specific and general components. The listener-specific component includes listener-specific, vertical variations in the Head-Related Transfer Function. The general component includes non-listener-specific, lateral variations in the Head-Related Transfer Function.

8 Claims, 12 Drawing Sheets

EFFICIENT PERSONALIZATION OF HEAD-RELATED TRANSFER FUNCTIONS FOR IMPROVED VIRTUAL SPATIAL AUDIO

Pursuant to 37 C.F.R. § 1.78(a)(4), this application is a continuation of U.S. application Ser. No. 14/560,792, filed 4 Dec. 2014 (pending), which claims the benefit of and priority to prior filed Provisional Application Ser. No. 61/911,641, filed 4 Dec. 2013. The disclosures of these previously filed applications are incorporated herein by reference, in their entireties.

RIGHTS OF THE GOVERNMENT

The invention described herein may be manufactured and used by or for the Government of the United States for all governmental purposes without the payment of any royalty.

FIELD OF THE INVENTION

The present invention relates generally to virtual spatial audio systems and, more particularly, to systems and methods of generating and utilizing head-related transfer functions for virtual spatial audio systems.

BACKGROUND OF THE INVENTION

A head-related transfer function ("HRTF") is a set of filters which individually describe the acoustic transformation of a sound as it travels from a specific location in space to a listener's ear canals. This transformation is caused by interaural differences in the acoustic transmission path and interactions with acoustic reflections from the head, shoulders, and outer ears. The HRTF represents all of the perceptually relevant acoustic information needed for a listener to determine a direction of sound origin.

Non-directional sounds, when transmitted to the listener, provide no cues as to the direction of sound origin. These otherwise non-directional sounds, with an HRTF applied thereto, may be utilized by virtual auditory display ("VAD") designers to impart a directional precept. Such capability has a broad range of applications from navigational aids for pilots and the visually-impaired to virtual and augmented reality for training and entertainment purposes.

Yet, the spatially-auditory cues represented by the HRTF are highly individualized. In other words, unique anatomical and spatial differences require a distinct HRTF for each individual to properly perceive the direction of sound origin. Thus, technologies to derive generalized HRTFs from measurements on individuals or acoustic manikins often result in unnatural sounding displays for listeners (i.e., a listener on which the measurements were not made) and result in a greater degree of mislocalization. When faithful reproduction of spatial auditory cues is necessary, HRTFs must be measured or estimated for each specific listener. Unfortunately, accurate measurement of individualized HRTFs by conventional methods requires taking acoustic measurements at a large number of spatial locations around the listener, who is outfitted with miniature, in-ear microphones. The HRTF measurement process requires a large amount of time and expensive equipment, which makes it use cost-prohibitive for many commercial applications.

Other conventional strategies for attaining individual measurements have included building costly and extensive spherical speaker arrays so that measurements can be made more rapidly. Alternatively still, smaller and cheaper movable speaker arrays may be used, but result in significantly longer measurement collection times. Some approaches have utilized a priori information about the HRTF in an attempt to aid interpolation from a generic HRTF to a listener specific HRTF.

While several of these conventional techniques show promising results in terms of reconstruction or modeling error, no explicit localization studies have been conducted to determine the exact number of spatial measurements required to achieve accurate localization. One problem with many of these conventional methods is the lack of a simple HRTF representation, which characterizes all of the perceptually-relevant HRTF features using only a small number of parameters. Personalization techniques could also benefit from more detailed knowledge of exactly how HRTFs differ among individuals, which is currently scarce. Yet, these methods do provide interesting frameworks for HRTF estimation that should, theoretically, be much more fruitful than current results would suggest. Thus, there remains a need for improved methods of personalizing HRTFs having perceptually-relevant information for proper source origin identification.

SUMMARY OF THE INVENTION

The present invention overcomes the foregoing problems and other shortcomings, drawbacks, and challenges of interpolating a fully-individualized HRTF representation without excessive expense and time. While the invention will be described in connection with certain embodiments, it will be understood that the invention is not limited to these embodiments. To the contrary, this invention includes all alternatives, modifications, and equivalents as may be included within the spirit and scope of the present invention.

According to an embodiment of the present invention, a Head-Related Transfer Functions includes a listener-specific component and a general component. The listener-specific component includes listener-specific, vertical variations in the Head-Related Transfer Function. The general component includes non-listener-specific, lateral variations in the Head-Related Transfer Function.

Still another embodiment of the present invention is directed a database of Head-Related Transfer Function. The database includes individual-specific, vertical variations derived from a plurality of Head-Related Transfer Functions.

Additional objects, advantages, and novel features of the invention will be set forth in part in the description which follows, and in part will become apparent to those skilled in the art upon examination of the following or may be leaned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and constitute a part of this specification, illustrate embodiments of the present invention and, together with a general description of the invention given above, and the detailed description of the embodiments given below, serve to explain the principles of the present invention.

It should be understood that the appended drawings are not necessarily to scale, presenting a somewhat simplified representation of various features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments have been enlarged or distorted relative to others to facilitate visualization and clear understanding. In particular, thin features may be thickened, for example, for clarity or illustration.

DETAILED DESCRIPTION OF THE INVENTION

While provided in some detail below, additional features and embodiments of the methods and systems described herein are provided in G. D. ROMIGH, "Individualized Head-Related Transfer Functions: Efficient Modeling and Estimation from Small sets of Spatial Samples," Ph.D. dissertation, Carnegie Mellon University, Pittsburgh, Pa., Dec. 5, 2012, 108 pages total. The disclosure of this dissertation is incorporated herein by reference, in its entirety.

Figure 1A:
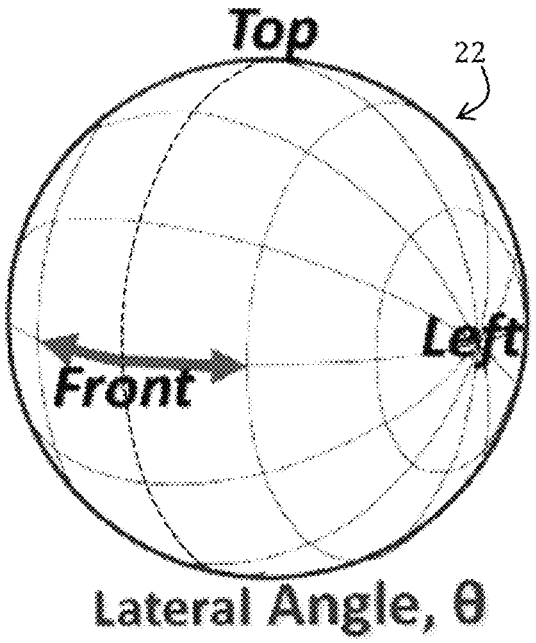
FIGS. 1A and 1B are schematic representations of a polar coordinate system for use in systems and methods according to embodiments of the present invention.
Figure 1B:
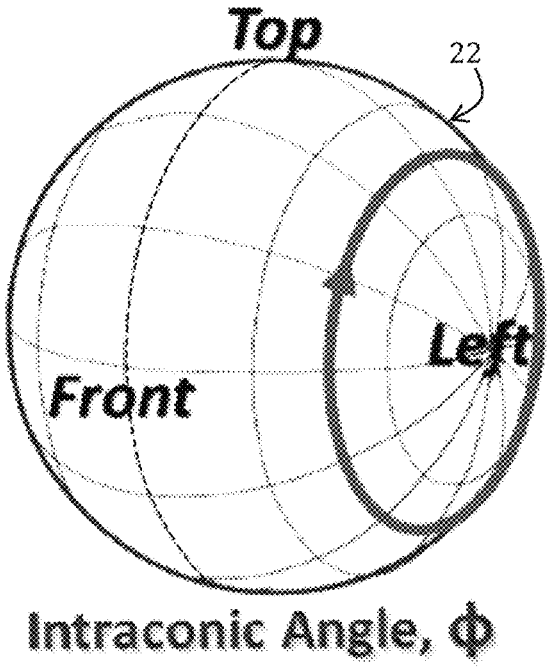
Figure 2:
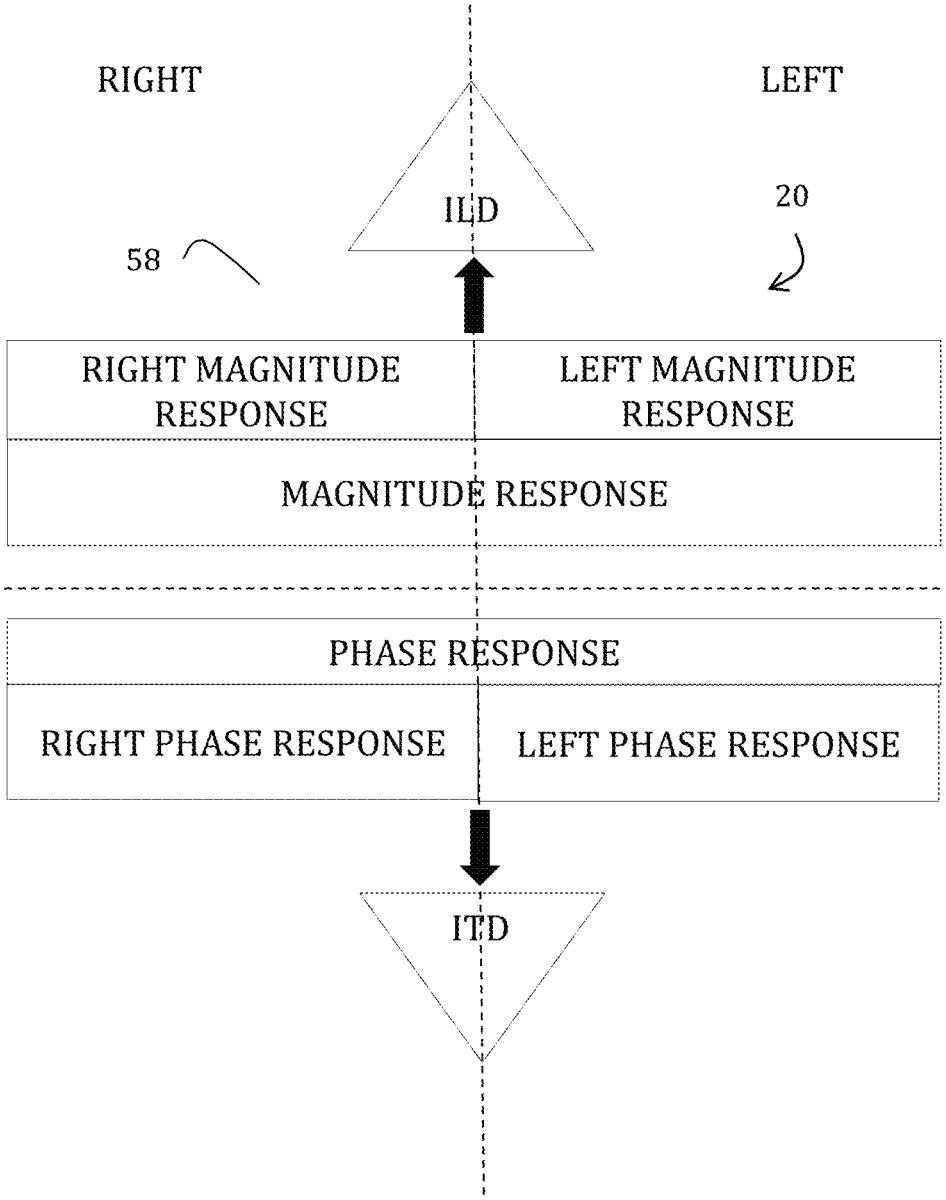
FIG. 2 is a schematic representation of individual left and right magnitude and phase responses for use in systems and methods according to embodiments of the present invention.

Turning now to the figures, and in particular to FIGS. 1A and 1B, one theory of spatial auditory perception centering on differences in times a sound arrives at a listener's two ears is shown. For a listener 20 positioned at center of a sphere 22 (note that listener 20 is shown in FIG. 2), a sample Head Related Transfer Function ("s-HRTF") may be used to describe the acoustic transformation of a sound traveling from each point in space on the sphere (φ,θ) about the listener to the listener's ear canals. Lateral localization cues (FIG. 1A) are given as an angle, θ, left or right from a point directly in front of the listener; vertical localization cues (FIG. 1B) are given as an angle, φ, above or below the point directly in front of the listener.

With reference now to FIG. 2, lateral localization cues may be taken from interaural timing differences ("ITD") at low frequencies and interaural level differences ("ILD") at high frequencies increase as a sound moves from midline to either side of the listener 20. Individual characters of the listener, such as anatomical dimensions of the ear and ITD, influence these lateral localization factors.

Each s-HRTF may, thus, be represented as a set of real spherical harmonic functions ($Y_{nm}(\varphi,\theta)$) having an order, n, and a mode (degree), m, of spherical angles $\{-\pi/2 \le \theta \le \pi/2\}$, $\{-\pi \le \varphi \le \pi\}$. For each spherical harmonic order n, there are 2n+1 individual basis functions, designated by the mode number $\{-n \le m \le n\}$. For a $P^{th}$ order spherical harmonic representation, there are $(P+1)^2$ basis functions:

$$Y_{nm}(\varphi,\theta) = \begin{cases} \frac{(2n+1)}{4\pi} P_n^m\left(\cos\left(\frac{\pi}{2}-\theta\right)\right) & \text{If } m = 0 \\ N_n^m P_n^m\left(\cos\left(\frac{\pi}{2}-\theta\right)\right)\cos(m\varphi) & \text{If } m > 0 \\ N_n^m P_n^{|m|}\left(\cos\left(\frac{\pi}{2}-\theta\right)\right)\sin(m\varphi) & \text{If } m < 0 \end{cases} \quad \text{Equation 1}$$

where $P_n^m$ corresponds to the associated Legendre Polynomial and $N_n^m$ is a normalization constant to ensure orthonormality of the basis functions.

An arbitrary continuous spatial function, h(φ,θ), can be formed by summation of a set of weighted $P^{th}$ order spherical harmonics:

$$h(\varphi,\theta) = \sum_{n=0}^{P}\sum_{m=-n}^{n} Y_{nm}(\varphi,\theta)C_{nm} \quad \text{Equation 2}$$

where $C_{nm}$ includes a set of spherical harmonic coefficients.

While lateral localization cues tend to be fairly consistent across individuals, intraconic localization cues vary greatly. As such, those coefficients within $C_{nm}$ corresponding to lateral variation may be listener-independent while those coefficients within $C_{nm}$ corresponding to intraconic spatial variation are largely listener-dependent. Moreover, highest degrees of inter-listener variance correspond to spherical harmonics where n=|m|, hereafter, "sectoral harmonics." That is, spatial auditory perception is most individualistic for those points in space (φ,θ) within a medial, sagittal plane, which is illustrated in FIGS. 1A and 1B as a dashed line on each sphere 20.

By defining an average coefficient values for lateral variations, $\overline{C}_{nm}$, a spherical harmonic representation for an individualized s-HRTF can be determined:

$$H \approx H_{Lat} + H_{Sec} \quad \text{Equation 3}$$

where $$H_{Lat} = \sum_{n=1}^{P}\sum_{m=-(n-1)}^{n-1} Y_{nm}\overline{C}_{nm} \quad \text{Equation 4}$$

-continued $$H_{Sec} = \sum_{n=0}^{P} (Y_{nn}C_{nn} + Y_{n,-n}C_{n,-n}) \quad \text{Equation 5}$$

Coefficients of the sectoral HRTF model may then be estimated from a limited number of sample HRTF measurements, typically taken along sagittal planes and corresponding to regions having the greatest degree of individuality. More particularly, and as described in greater detail below a number of measured, sectoral, s-HRTFs may be limited by constraining measurements to a median plane.

Given a number, S, of spatial measurements and a truncation order, P, ITD at a single frequency, h, may be reconstructed from a linear combination of the spherical harmonic basis functions given in Y via an individualized set of spherical harmonic coefficients, c:

$$h=Yc$$

where $$h=[h(\varphi_1,\theta_1),h(\varphi_2,\theta_2), \ldots h(\varphi_S,\theta_S)]^T$$

$$c=[C_{00},C_{1-1},C_{10},C_{11}, \ldots ,C_{PP}]^T$$

$$Y=[y_{00},y_{1-1},y_{10},y_{11}, \ldots ,y_{PP}]^T$$

and $$y_{nm}=[Y_{nm}(\varphi_1,\theta_1), \ldots ,Y_{nm}(\varphi_S,\theta_S)]^T \quad \text{Equation 6}$$

Two terms can now be obtained by splitting this representation according to the sectoral model described above: a first term that is dependent only on sectoral coefficients and a second term that is dependent only on non-sectoral coefficients:

$$h=Y_{Lat}c_{Lat}+Y_{Sec}c_{Sec} \quad \text{Equation 7}$$

As only sectoral coefficients are presumed to be listener-specific, a new sectoral-HRTF vector, $h_{sec}$, may be defined having the full s-HRTF with non-sectoral components removed, e.g., having only the listener-specific, sectoral components.

$$h_{sec} \approx h - Y_{Lat}\bar{c}_{Lat} \quad \text{Equation 8}$$

$$\approx Y_{Sec}c_{Sec}$$

Sectoral, listener-dependent components may be estimated using a Bayesian estimation strategy according to one embodiment of the present invention, by modeling the HRTF with a multi-variate normal distribution on the coefficient vector, c. In other words, given some mean coefficient vector, $\bar{c}_{sec}$, and a covariance matrix, $R_{Sec}$, the HRTF coefficients are presumed to be distributed as c:N ($\bar{c}_{Sec}$, $R_{Sec}$).

$$\hat{c}_{Sec} = E[c \mid h_{Sec}] = \quad \text{Equation 9}$$

$$\bar{c}_{Sec} + R_{Sec}Y_{Sec}^T(Y_{Sec}R_{Sec}Y_{Sec}^T + \sigma^2 I)^{-1}(h_{Sec} - Y_{Sec}\bar{c}_{Sec})$$

Thus, sectoral coefficients may be estimated from measurements made at a first plurality of locations. The s-HRTF at any location (φ,θ) can then be estimated according to Equation 7, with estimated values for the sectoral coefficients and the listener-independent later coefficients.

Figure 3:
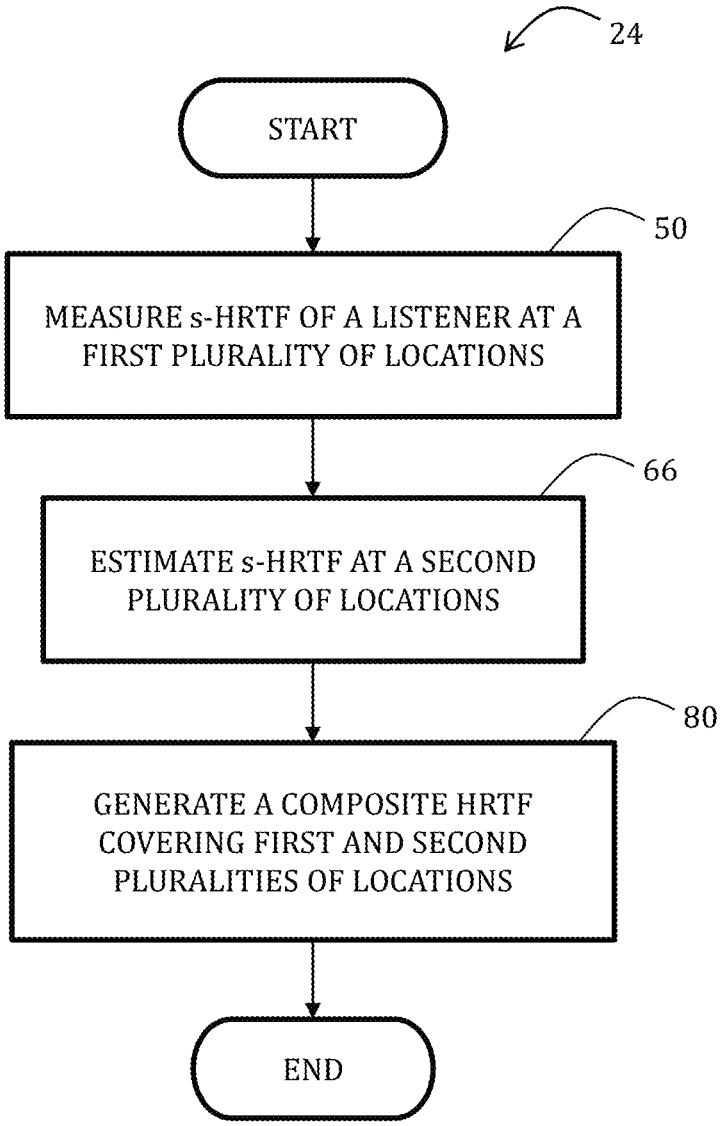
FIG. 3 is a flowchart illustrating a method of generating a composite HRTF for a listener according to an embodiment of the present invention.

And now, with reference to the flowchart of FIG. 3, a method 24 of estimating a composite Head Related Transfer Function ("HRTF") from a measured, subset of s-HRTFs according to an embodiment of the present invention is shown. The method 24, given the iterative processes and mathematical complexity or transforming audio waveforms via the particular s-HRTF, should be completed by way of a computing system 26 (FIG. 4).

Figure 4:
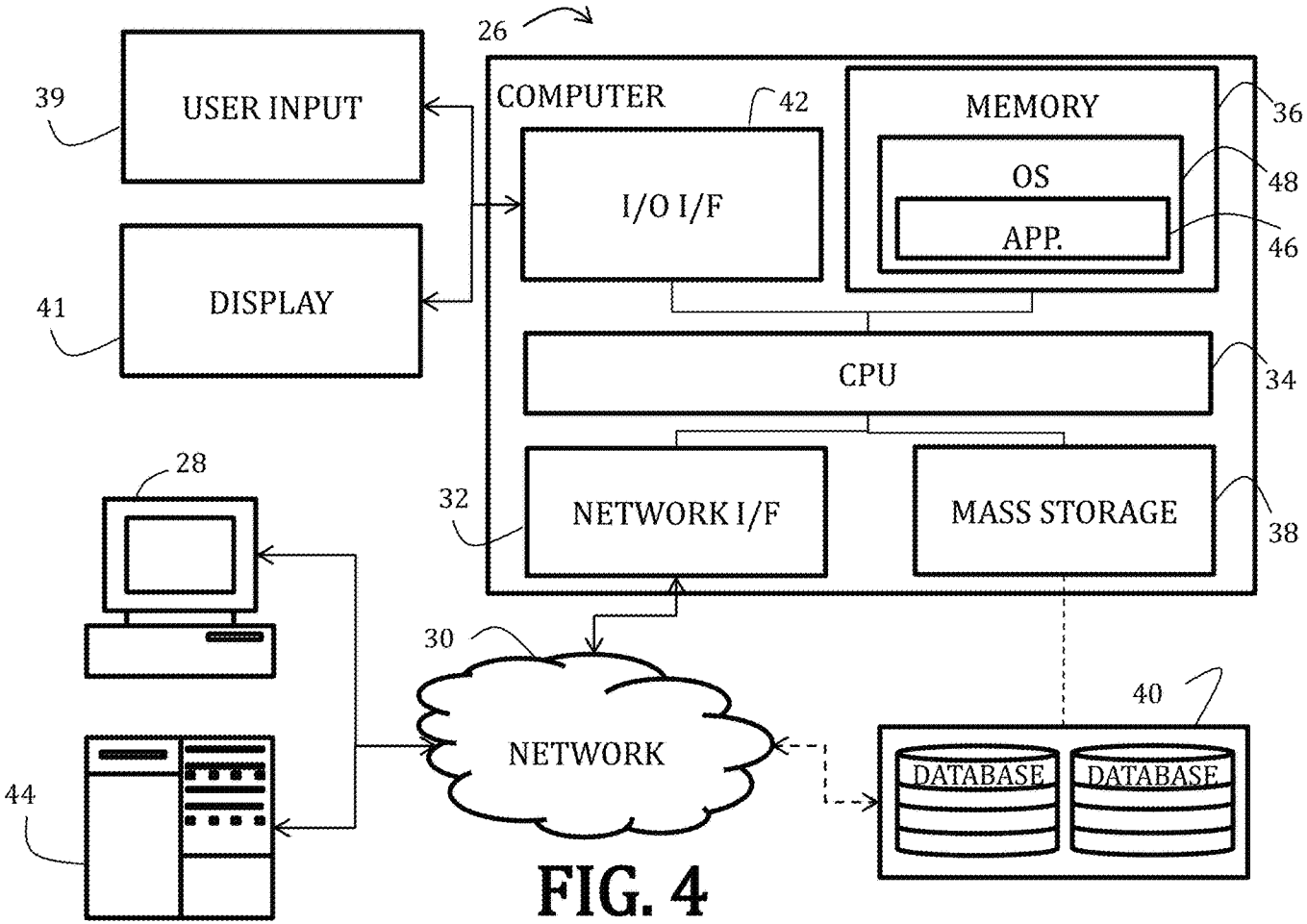
FIG. 4 is a schematic representation of a computer suitable for use with systems and methods according embodiments of the present invention.

In that regard, and with reference to FIG. 4, the details of the computing system 26 suitable for performing the method 24 of FIG. 3 is described. The illustrative computing system 26 may be considered to represent any type of computer, computer system, computing system, server, disk array, or programmable device such as multi-user computers, single-user computers, handheld devices, networked devices, or embedded devices, etc. The computing system 26 may be implemented with one or more networked computers 28 using one or more networks 30, e.g., in a cluster or other distributed computing system through a network interface 32 (illustrated as "NETWORK I/F"). The computing system 26 will be referred to as "computer" for brevity's sake, although it should be appreciated that the term "computing system" may also include other suitable programmable electronic devices consistent with embodiments of the invention.

The computer 26 typically includes at least one processing unit 34 (illustrated as "CPU") coupled to a memory 36 along with several different types of peripheral devices, e.g., a mass storage device 38 with one or more databases 40, an input/output interface 42 (illustrated as "I/O I/F") coupled to a user input 39 and display 41, and the Network I/F 32. The memory 36 may include dynamic random access memory ("DRAM"), static random access memory ("SRAM"), non-volatile random access memory ("NVRAM"), persistent memory, flash memory, at least one hard disk drive, and/or another digital storage medium. The mass storage device 38 is typically at least one hard disk drive and may be located externally to the computer 26, such as in a separate enclosure or in one or more networked computers 28, one or more networked storage devices 44 (including, for example, a tape or optical drive), and/or one or more other networked devices (including, for example, a server).

The CPU 34 may be, in various embodiments, a single-thread, multi-threaded, multi-core, and/or multi-element processing unit (not shown) as is well known in the art. In alternative embodiments, the computer 26 may include a plurality of processing units that may include single-thread processing units, multi-threaded processing units, multi-core processing units, multi-element processing units, and/or combinations thereof as is well known in the art. Similarly, the memory 36 may include one or more levels of data, instruction, and/or combination caches, with caches serving the individual processing unit or multiple processing units (not shown) as is well known in the art.

The memory 36 of the computer 26 may include one or more applications 46 (illustrated as "APP."), or other software program, which are configured to execute in combination with the Operating System 48 (illustrated as "OS") and automatically perform tasks necessary for performing the method of FIG. 3, with or without accessing further information or data from the database(s) 40 of the mass storage device 38.

Those skilled in the art will recognize that the environment illustrated in FIG. 4 is not intended to limit the present invention. Indeed, those skilled in the art will recognize that other alternative hardware and/or software environments may be used without departing from the scope of the invention.

In any event, and with reference again to FIG. 3, a first plurality of s-HRTF for the listener 20 (FIG. 2) is measured at a first plurality of locations (Block 50). The first plurality may include any arrangement and number of locations about the listener 20 (FIG. 2), whether regular or irregular. That is, the locations may be randomly selected or may comprise a particular arrangement, such as circumferentially, sagittally, coronally, axially, and so forth. According to one particular embodiment of the present invention, and as laid out in detail above, the first plurality may be arranged along a sagittal plane.

The number of measured s-HRTFs may be at least partially dependent on the arrangement selected and on the method of measurement. Generally, the number of s-HRTF may range from 1 to infinity.

Measuring the first plurality of s-HRTFs may be completed in any acoustically treated facility and in accordance with any manner known to those of ordinary skill in art. According to the illustrative embodiment of FIG. 5, the facility may be the Auditory Localization Facility ("ALF") at the Air Force Research Laboratory, Dayton, Ohio. As shown, ALF includes a 7 ft radius geodesic sphere 52 located within a large anechoic chamber 54. A plurality of speakers 56 (277 speakers for the ALF, although not all 277 are shown) are placed about, and at vertices of, the geodesic sphere 52. The listener 20 is positioned within the sphere 52 such that the listener's head 58 is located approximately centrally therein.

Figure 5:
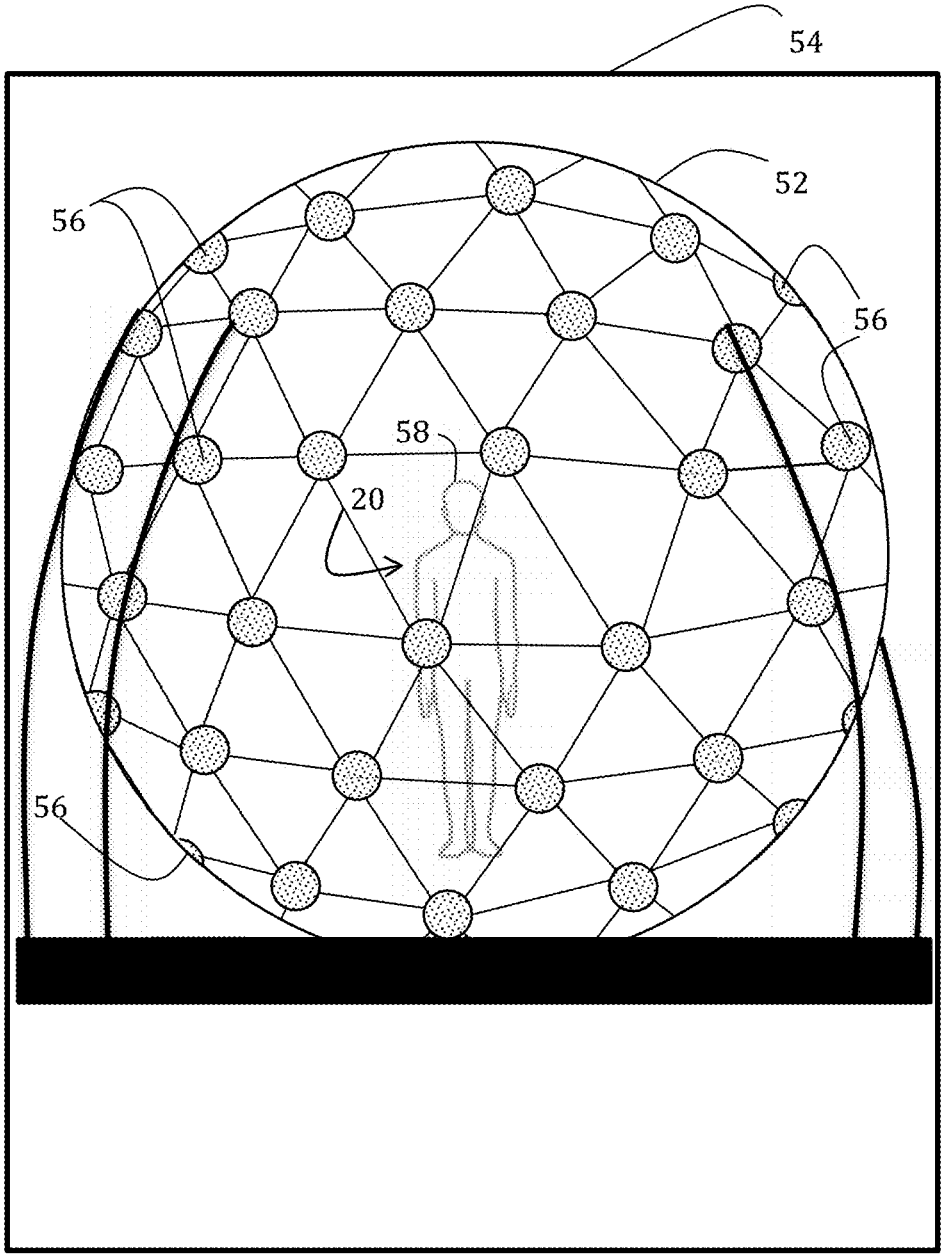
FIG. 5 is a side-elevational view of a schematic representation of an auditory localization facility suitable for use with embodiments of the present invention.
Figure 6:
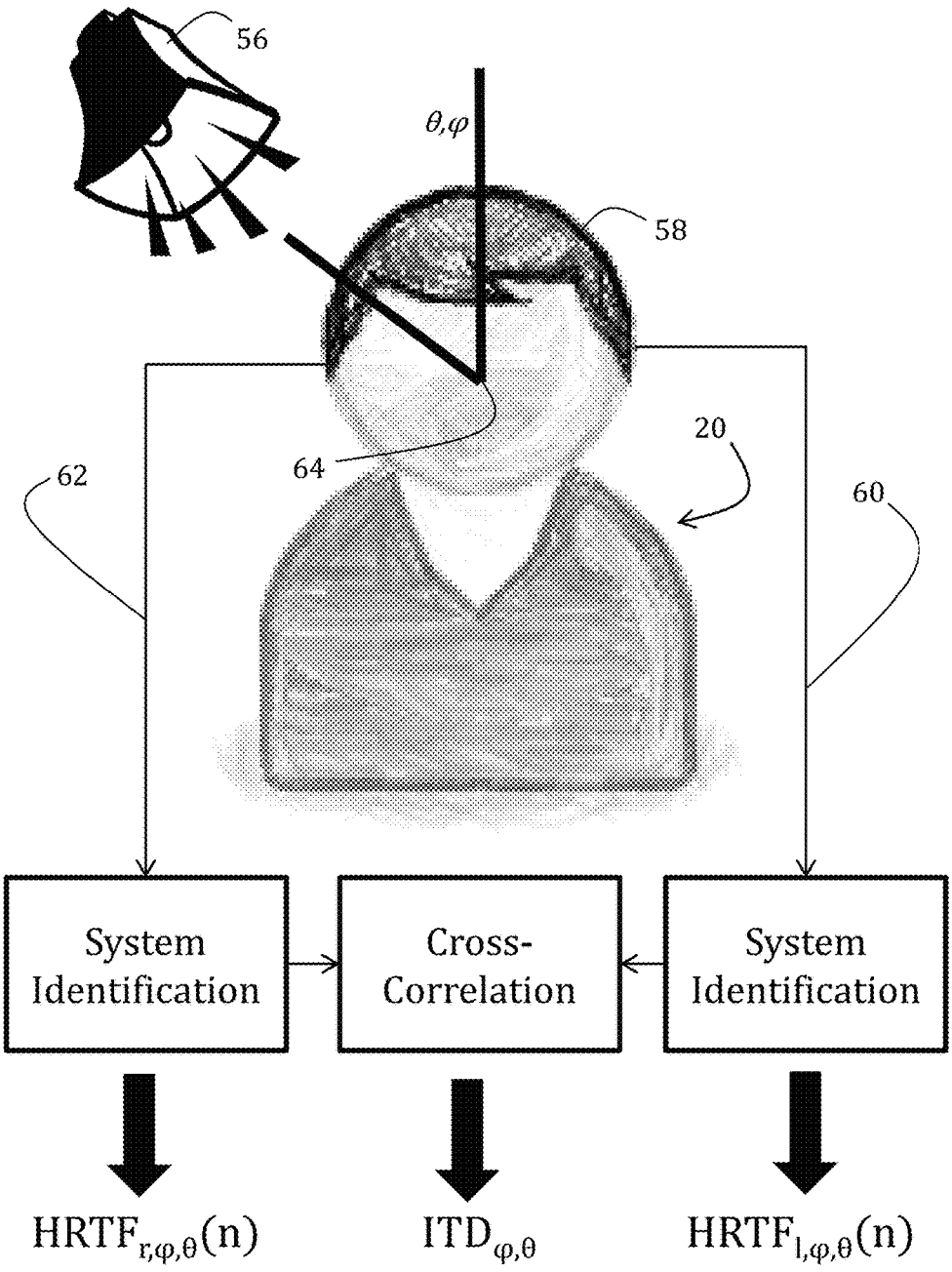
FIG. 6 is a schematic representation illustrating the method of FIG. 3.

Referring now to FIG. 6 with FIG. 5, and with the listener positioned with the sphere 52, the listener's ears (not shown) are fitted with miniature, in-ear microphones (also not shown). An audio signal 60, for example, a single tone or a train of a plurality of chirps, may be transmitted from any one of the plurality of speakers 56 (positioned at a point $(\varphi,\theta)$ relative the listener's heard 58) and a received signal (that is, a head-related impulse response ("HRIR") is received by each in-ear microphone. According to the particular illustrative embodiment, the audio signal 60 consisted of a train of seven periodic chirp signals, each sweeping from about 200 Hz to about 15 kHz in the span of 2048 samples and at a 44.1 kHz sampling rate. This 325-ms chirp train may be prefiltered to remove differences in frequency response between speakers 56 and presented to the listener 20. The process may be repeated for any number of speakers 56, for example, a number of speakers correlated with the number of locations comprising the first plurality.

The received HRIR 60, 62 from each in-ear microphone is recorded and a Fourier transform of each yields left and right s-HRTF, respectively, for the point $(\varphi,\theta)$ at a radius, r, from center 64. The left and right s-HRTFs may, if desired, be cross-correlated to determine the ITD for the listener 20. More specifically, ITD values may be extracted from the raw HRIRs by comparing the best linear fit to the phase response of each ear, for example, from between 300 Hz and 1500 Hz.

With listener-specific s-HRTFs measured for a first plurality of locations (Block 50), the s-HRTFs are fit to the spherical harmonic representation using the Bayesian estimation, as explained above. Such coefficients may be saved in the databases 40 (FIG. 4) and/or used to comparison against the database 40 (FIG. 4) of coefficients so as to determine an individual listener's deviation from normal, as described in greater detail below.

With respect to establishing the database 40 (FIG. 4), s-HRTFs are acquired for each of a plurality of listeners and processed in accordance with the methods provided above. Briefly, each listener, respectively, is positioned and a test stimulus is played from each loudspeaker 56 (FIG. 5). The test stimulus may vary, but according to the particular illustrative embodiment, consisted of a train of seven periodic chirp signals, each sweeping from about 200 Hz to about 15 kHz in the span of 2048 samples and at a 44.1 kHz sampling rate. This 325-ms chirp train was prefiltered to remove differences in the frequency response between speakers 56 (FIG. 5) and presented to the listener 20 (FIG. 2). Binaural recordings were made of each stimulus, and raw HRTFs were calculated by averaging the response of the five interior chirps of each train and stored as an inverse discrete Fourier Transform of the HRTF (hereafter, "HRIR").

According to some embodiments of the present invention, a position of the listener's head 58 (FIG. 2) may be recorded before, during, or after presentation of the stimulus from each speaker 56 (FIG. 5), or combinations thereof. Accordingly, the acoustically treated facility may include a tracking system (not shown), such as a commercially-available IS-900 (InterSense, Billerica, Mass.), configured to detect a position and location of the listener's head 58 (FIG. 2) within space and to relate the position and location of the listener's head 58 (FIG. 2) to the location of the perceived sound source. In that regard, when the signal is input into the and split into left and right signals, tracking data, indicative of the head position and location as determined by the tracking system, is input as well.

Once the procedure is complete for each speaker 56 (FIG. 5), ITD values may be extracted, as indicated above. The raw 2048 sample HRIRs may be windowed, for example, by applying a 401 sample Hanning window, centered on the strongest peak of each HRIR, to reduce the effects of any residual reflections due to the acoustically treated facility. The windowed HRIRs were then converted to minimum phase before being truncated to 256 taps with a rectangular window.

Figure 7:
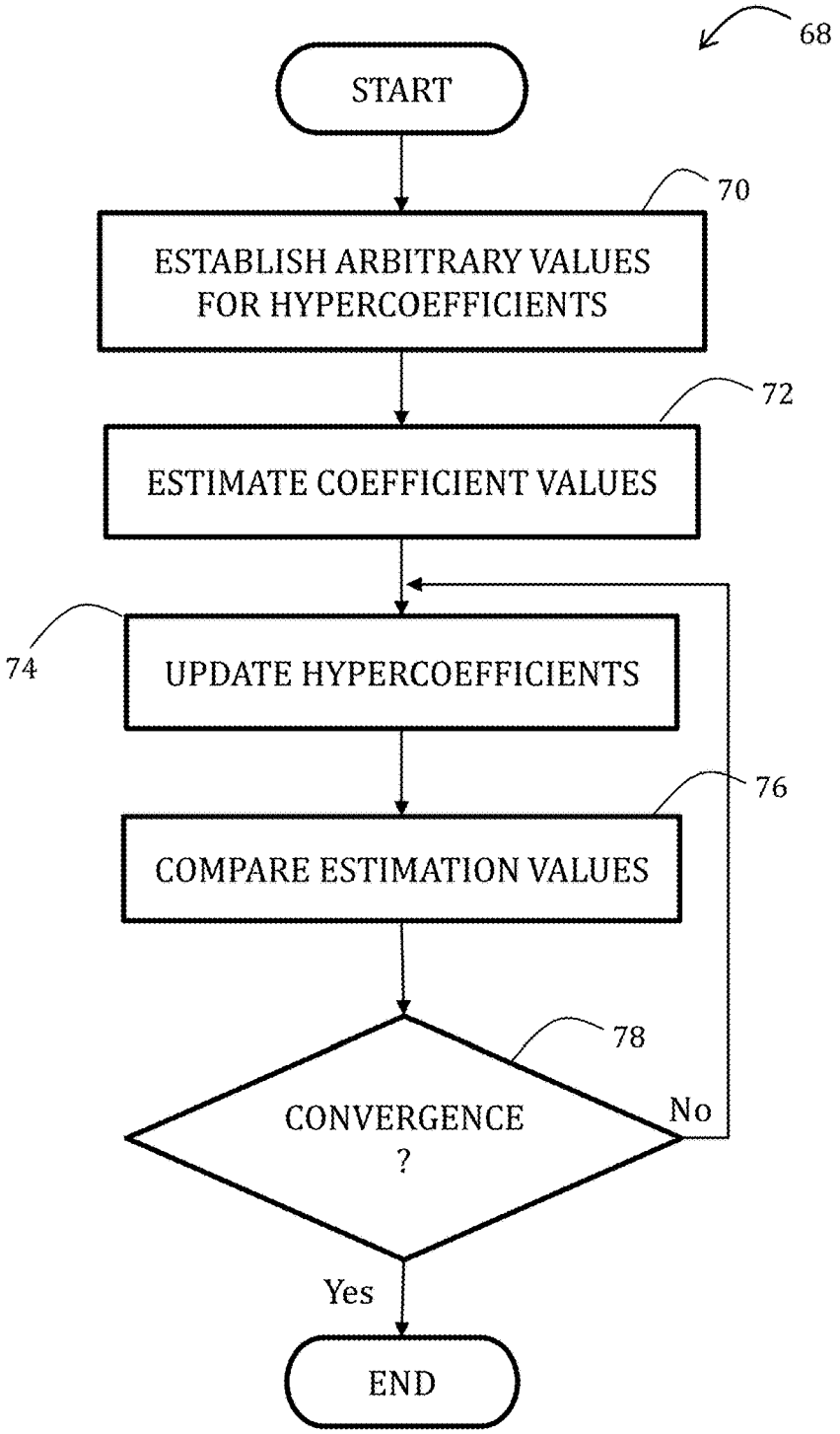
FIG. 7 is a flowchart illustrating a method of generating spherical harmonic coefficient values by comparing an individual's response to a database and in accordance with embodiments of the present invention.

Referring again to FIG. 3, and with the database 40 (FIG. 4) established and s-HRTFs acquired for a first plurality of locations for a listener 20 (FIG. 2), s-HRTFs at a second plurality of locations may be estimated for the listener 20 (FIG. 2) (Block 66). In that regard, a method 68 of estimating is described with reference to FIG. 7 and Equation 9. Within Equation 9, the term $(h_{Sec}-Y_{Sec}\bar{c}_{Sec})$ is the difference between the listener's s-HRTF at a given location and the average (or other generalization of the distribution of coefficients) s-HRTF at the given location.

To start, arbitrary values for the hypercoefficients, $R_{Sec}$ and $\bar{c}_{Sec}$, are set (Block 70) such that Bayesian estimates can be made of the spherical harmonic coefficients (Block 72). Of course, those skilled in the art would readily appreciate, given the disclosure herein, that other estimation algorithms may alternatively be used. Estimation values may be determined from a measurable individual character of the listener 20, such as a previous HRTF measurement, an anthropometric measurement (distance between ears, size of ears, etc.), a spatial audio evaluation, or an interaural timing difference, just to name a few. Resultant estimated coefficient values may then be used to update the estimates of $R_{Sec}$ and $\bar{c}_{Sec}$ (Block 74), which are evaluated against the distribution of coefficients of the database (Block 76). Any suitable evaluation strategy may be used, such as by a conventional Minimum Variance Unbiased ("MVUB") estimator, where:

$$\bar{c}_{Sec} = \frac{1}{M}\sum_{i=1}^{M} c_i \quad \text{Equation 10}$$

$$\hat{\sigma}_j^2 = \frac{1}{M-1}\sum_{i=1}^{M}(c_i[j] - \bar{c}_{Sec}[j])^2 \quad \text{Equation 11}$$

Estimation and evaluation continue, iteratively ("No" branch of Decision Block 78), until estimates converge ("Yes" branch of Decision Block 78). The resultant, converged coefficients may be applies to a sound for the particular listener 20 (FIG. 2). Although not specifically shown, the process may further be repeated for any number of locations, establishing a second plurality.

Figure 8:
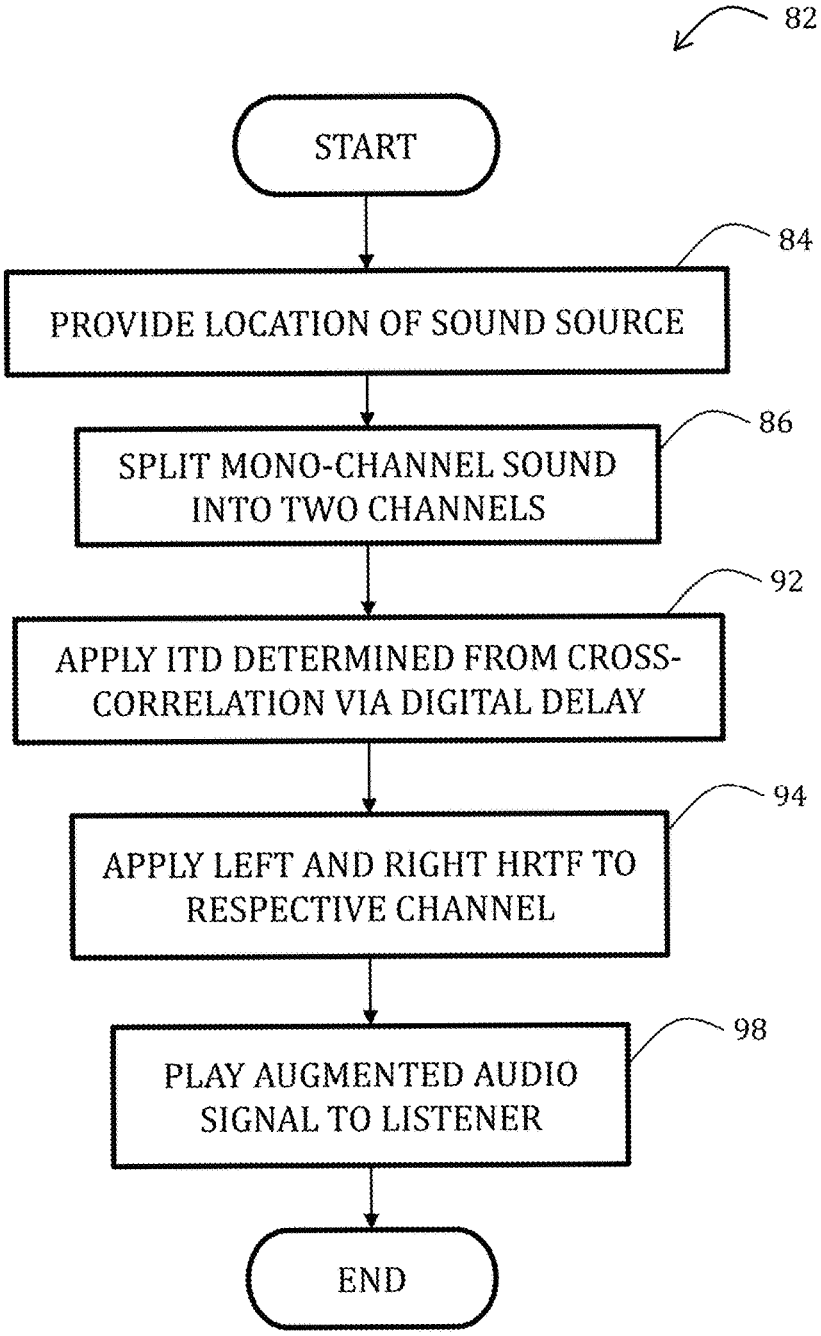
FIG. 8 is a flowchart illustrating a method of applying a composite HRTF, generated in accordance with an embodiment of the present invention, to a mono-channel sound for audio presentation to a listener.

Referring again to FIG. 3, and with s-HRTFs estimated for the second plurality of locations, a composite HRTF for the listener may be generated (Block 80), which may then be used to augment audio signal in accordance with embodiments of the present invention. As such, and with reference now to FIGS. 8 and 9, a method 82 of applying a listener-specific HRTF to a mono-channel sound source according to an embodiment of the present invention is shown. Generally, a sound and a to-be perceived location for that sound are determined (Block 84). The to-be perceived location may be translated into spherical coordinates so as to correlate with the individual HRTF. The sound, being mono-channel, is split into two channels (Block 86), for example, left and right channels corresponding to the listener's left and right ears, respectively (although the sounds are generally supplied to the listener 20 by way of left and right earphones 88, 90).

A digital delay is generated between the left and right channels as determined by the ITD (Block 92). The ITD, as discussed above, is determined by cross-correlating the HRIR. Thus, the previously determined ITD values may be loaded and applied to the channels as appropriate. Subsequently, the left and right s-HRTFs are applied to respective channels by way of a real-time FIR filter (Block 94), which is then provided to the listener 20 by way of the headphones 96 (Block 98).

The process may be repeated for changes in the perceived location of the sound, movement of the listener's head or both. Otherwise, the process may end.

The following examples illustrate particular properties and advantages of some of the embodiments of the present invention. Furthermore, these are examples of reduction to practice of the present invention and confirmation that the principles described in the present invention are therefore valid but should not be construed as in any way limiting the scope of the invention.

EXAMPLE 1 s-HRTFs for listeners were recorded using the Auditory Localization Facility ("ALF") of the Air Force Research Labs in Dayton, Ohio (illustrated in FIG. 5), which has been shown to produce HRTFs which maintain the localization abilities of human subjects with free field stimuli.

For each s-HRTF, a test stimulus is played from each of the 277 loudspeakers located at vertices of the sphere. The test stimulus consisted of a train of seven periodic chirp signals each swept from 200 Hz to 15 kHz in the span of 2048 samples at a 44.1 kHz sampling rate. The 325-ms chirp train was prefiltered to remove any differences in the frequency response between speakers and was presented to each listener. Binaural recordings were made of each stimulus.

Before the onset of each stimulus presentation, the position of the listener's head was recorded and, later, used to calculate a head-relative location for storage.

Raw s-HRTFs were calculated by averaging the response of the five interior chirps of each train and were stored as HRIRs (the inverse Discrete Fourier Transform of the HRTF). The raw 2048 HRIRs were windowed by applying a 401 sample Hanning window, centered on the strongest peak of each HRIR so as to reduce the effects of any residual reflections within the ALF facility.

ITD values were extracted from the raw HRIRs by comparing the best linear fit to a phase response of each ear between 300 Hz and 1500 Hz. The windowed HRIRs were then converted to minimum phase before being truncated to 256 taps with a rectangular window.

Each listener's s-HRTFs were used to estimate a set of coefficients of a $6^{th}$ order spherical harmonic representation for the 274 available locations. The estimations were made using (1) a conventional least squares technique and (2) a Bayesian technique in accordance with an embodiment of the present invention. Sampled locations were picked to be approximately equally distributed along a surface of the sphere and varied from one HRTF to the next.

Figure 10:
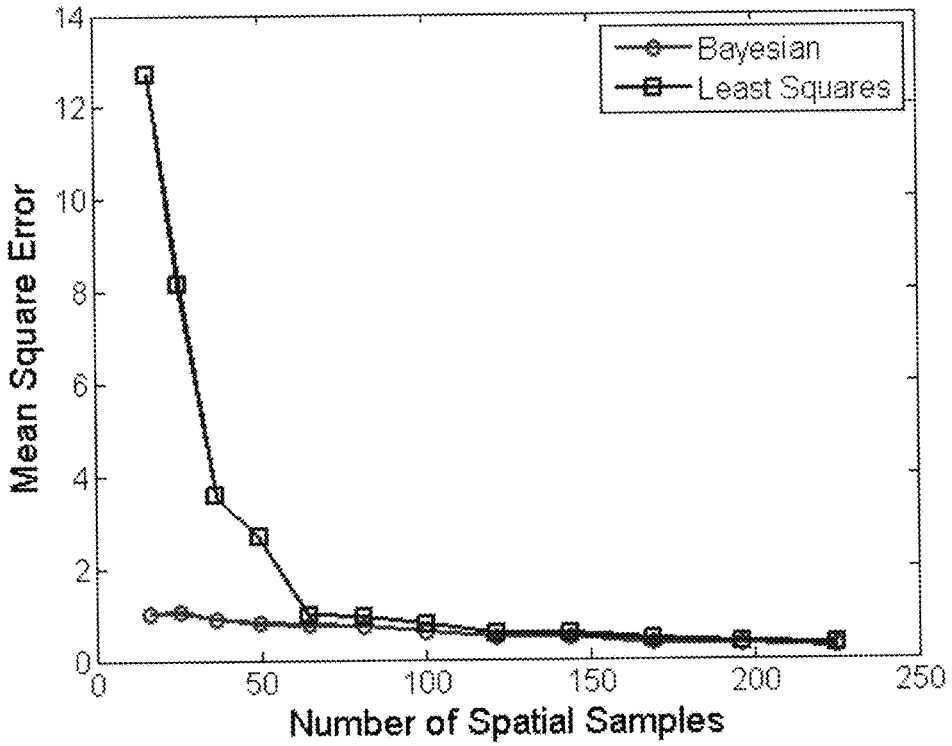
FIG. 10 is a graphical representation of the mean square error for a least squares coefficient estimation and Bayesian coefficient estimation according to an embodiment of the present invention.

FIG. 10 illustrates the mean square error ("MSE") between the coefficients estimated using the reduced set and the coefficients found using all 274 locations is plotted in as a function of the number of samples used in the estimation. For example, a 6th-order model included 49 coefficients. The least squares approach begins to degrade significantly as with small numbers of available spatial samples towards the theoretical limit for a unique solution. In contrast, the mean square coefficient error using the proposed Bayesian technique remains quite stable, and shrinks linearly as the number of spatial samples increases. Accordingly, the Bayesian estimation technique may be capable of accurately estimating the SH coefficients with as few spatial samples as the number of coefficients in the model, or less.

EXAMPLE 2

Generation of a database of lateral s-HRTF was performed by acquiring s-HRTFs in accordance with the method of Example 1 for 44 listeners. Estimation of coefficients by establishing initial values for hyperparameters, $\bar{c}_{Sec}$ and $R_{Sec}$ according to embodiments of the present invention was completed. In that regard, the Bayesian technique of Example 1 was used to estimate the set of coefficients of the $6^{th}$ order spherical harmonic representation. An Expectation-Maximization algorithm for a 6th-order SH representation.

Figure 9:
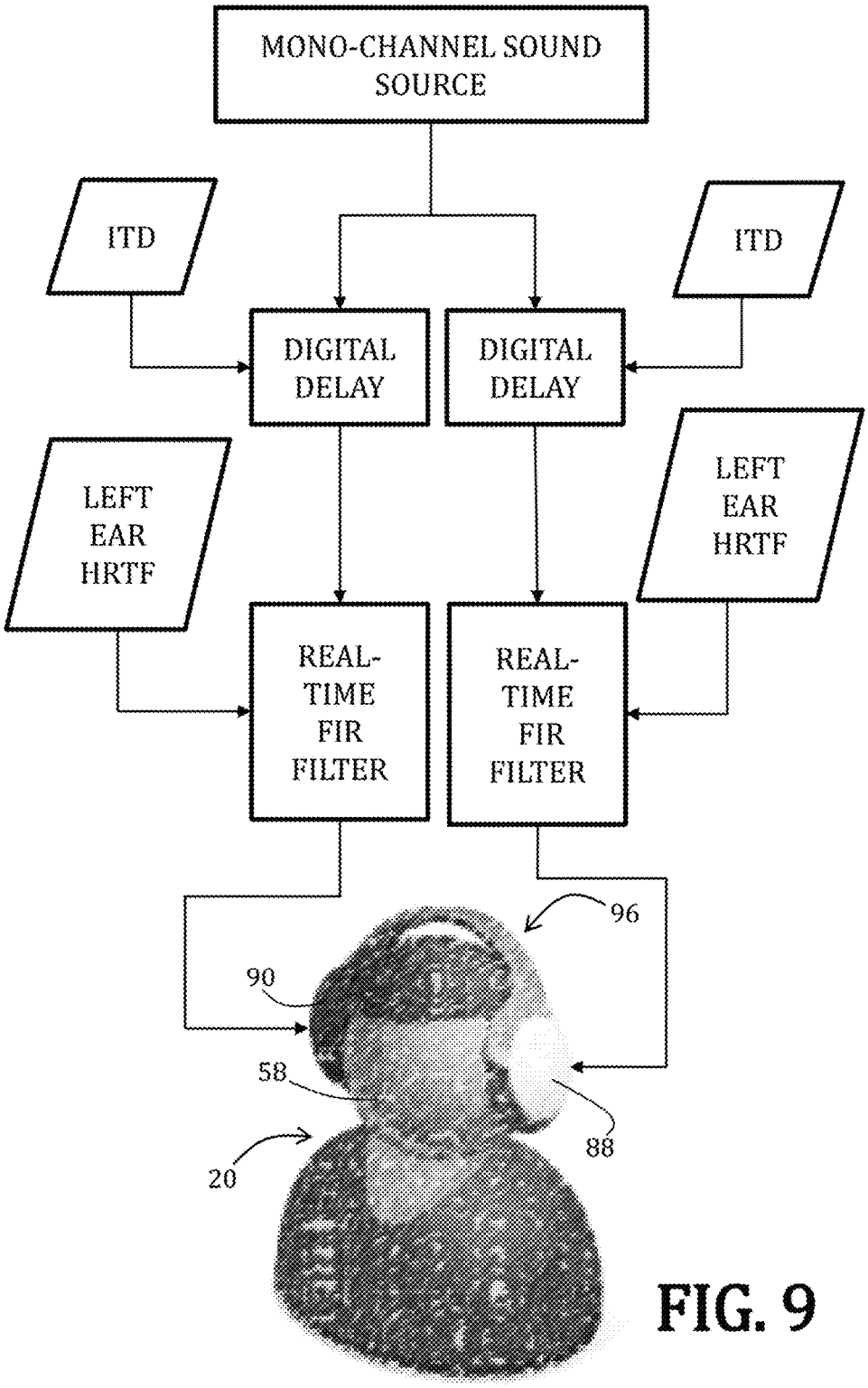
FIG. 9 is a schematic representation illustrating the method of FIG. 8.
Figure 11:
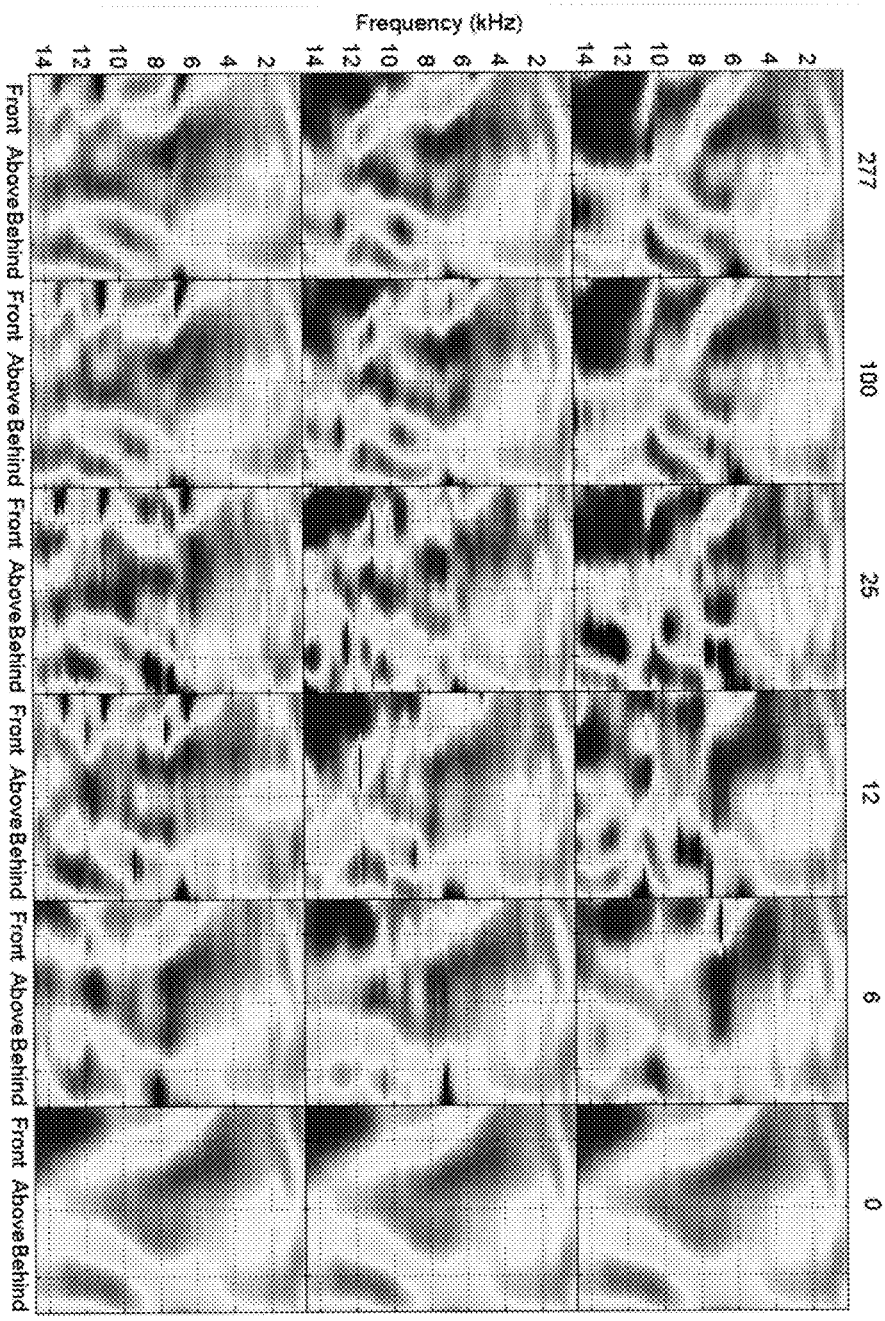
FIG. 11 is a two-dimensional graphical representation of $4^{th}$ order HRTF magnitude (in dB) for three exemplary listeners (one per row) plotted as a function of angle about the median plane.

FIG. 11 illustrates three estimated subject HRTFs (one per row) taken along the median plane with a decreasing number of spatial measurements used (indicated by column headings). The subject HRTFs begin to lose individuality and become more similar to an average HRTF (zero measurements) as the number of spatial samples is reduced. FIG. 9 further illustrates an increased noisy characteristic of the estimated subject HRTFs when only a few measurements are used, which may be due to the frequency-by-frequency form of the estimation. It is likely that the degradation is undetectable due to the frequency resolution limitations of the peripheral auditory system.

EXAMPLE 3

Perceptual evaluations were conducted in the ALF, described above in Example 1, wherein each vertex of the sphere contains a loudspeaker (Bose Acoustimass, Bose Corp., Framingham, Mass.) and a cluster of four LEDs. The ALF included a 6-DOF tracking system (Intersense IS900, Thales Visionix, Inc., Billerica, Mass.) configured to simultaneously track the listener's head position and the position of a small hand-held pointing device. The system is such that real-time visual feedback can be given to the listener about the orientation of the wand or the listener's head by lighting up the LED cluster which corresponds most closely to the orientation direction. During HRTF collection, listeners were asked to stand in the center of the sphere with their head oriented toward a designated speaker location. Before each set of test stimuli were presented, the position and orientation of the listener's head was recorded and the corresponding location modified to correspond to its position relative to the head.

The test stimulus consisted of a train of seven periodic chirp signals which swept from 100 Hz to 15 kHz in the span of 2048 points at a 44.1-kHz sampling rate. This 325 ms chirp train was pre-filtered to remove any differences in the frequency response between speakers, and presented with the stimuli from 15 other speaker locations with a 250 ms inter-stimulus interval. Binaural recordings were made of the response to each signal. Raw HRTFs were calculated by averaging the response of the five interior chirps of each train and stored as HRIRs (the inverse Discrete Fourier Transform ("DFT") of the HRTF). This procedure was repeated until all 277 loudspeaker positions had been measured. A similar technique was also employed to calculate a set of custom headphone correction filters. In this case the test signal was presented overhead phones and recorded with the in-ear binaural microphones. The resulting correction filters were then used to correct the HRTF measurements for the headphone presentation.

The raw 2048-sample HRIRs were windowed by applying a 401-sample Hanning window centered on the strongest peak of each HRIR to reduce the effects of any residual reflections within the ALF. ITD values were extracted from the raw HRIRs by comparing the best linear fit to the phase response of each ear between 300 Hz and 1500 Hz. The windowed HRIRs were then corrected for the response of the headphones and converted to minimum phase before being truncated to 256 taps with a rectangular window. The ITDs were reintroduced by delaying the contralateral minimum-phase HRIR by the ITD value.

At the beginning of each 30 min experimental session, HRTF and headphone correction were measured using the procedure outlined above. This overall process from microphone fitting to the end of collection took approximately 5 min to 6 min after which the listener was asked to complete three 60 trial blocks of a localization task. On each trial the listener was presented with a short stimulus and asked to indicate the perceived direction by orientating the tracked wand toward the perceived location and pressing a response button. The correct location was then presented to the subject by illuminating the LEDs on the actual speaker location, which was then acknowledged via a button press. Listeners were then required to reorient toward the zero-zero direction before they could initiate the start of the next trial by again pressing the button.

All of the stimuli were a 250 ms burst of white noise which had been band-passed between 500 Hz and 15 kHz and windowed with 10 ms onset and offset ramps. The stimuli was convolved with an HRTF and presented to the subject through a pair of custom earphones. All target locations corresponded to one of 245 speaker locations which are above −45° in elevation. Low elevations were excluded from testing because of interference from the listener platform contained in the ALF. The HRTFs for all trials within one 60 trial block were generated using the spherical harmonic smoothing technique discussed above for a specific spherical harmonic order. A baseline condition was also included in the study which consisted of the original processed HRTF with no spatial processing.

Figure 12A:
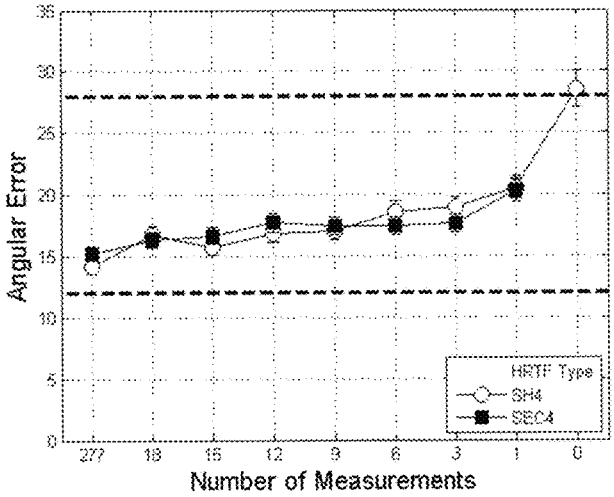
FIGS. 12A-12C are graphical representations of average total angular response error, lateral response error, and intra-conic response error (corrected for target lateral position), respectively, measured in degrees, for all tested spherical harmonic representation orders.
Figure 12B:
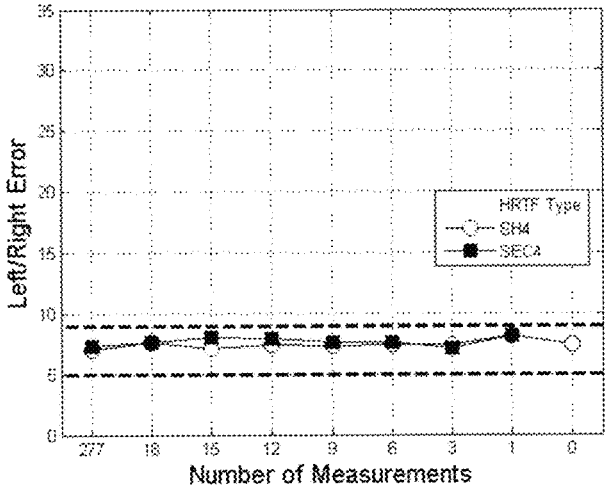
Figure 12C:
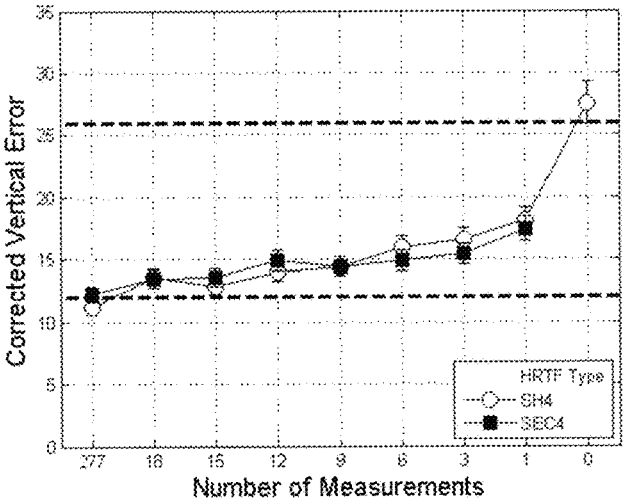

FIGS. 12A-12C illustrates results from the perceptual validation task and demonstrate the average absolute angular localization error between the intended location and the listener's directional response. This total angular error is then broken down into its lateral and intraconic components in FIGS. 12B and 12C, respectively. The bold dotted lines in each of FIGS. 12A-12C represent the corresponding errors from a previous study using free-field stimuli (bottom lines) and non-individualized HRTFs (top lines).

The total angular error when locations are equally distributed (SH) and when locations are confined to the median plane (SEC) increases as the number of locations is decreased from around 15° with all 277 measurement locations to around 20° with only a single location. Across all conditions, the sectoral model seems to perform similarly to that of the full SH model. Both models resulted in performance similar to free-field performance when all 277 measurement locations were used and significantly better than non-individualized performance even with only a single measurement. The intraconic errors seem to account for most of the performance degradations as the number of locations decrease since the lateral error shows little difference amongst the two measurement distributions or the number of measurements.

As provided in detail herein, sectoral HRTF models according to the embodiments of the present invention describe herein may be utilized to improve performance with any HRTF personalization strategy seeking to improve the accuracy of estimated HRTFs by relating the personalization strategy to individual characteristics of the listener (e.g., individualized HRTF measurements, anthropometric measurements, subjective selection, etc.). If a small number of individualized HRTF measurements are available, then the estimation methods according to the embodiments of the present invention may be applied, regardless of the methods with which the HRTFs were measured. The preferred set of measurements is acquired for locations that are a) spatially distributed on a sphere or b) distributed around the median plane. Once a set of measurements are available, the methods according to embodiments of the present invention can be used to interpolate the samples to any arbitrary set of directions desired for playback of spatialized audio.

The methods according to the present invention, and as described herein, may significantly reduce the number of spatial samples (from the conventional 150 spatial samples shown to fully preserve localization accuracy) necessary for modeling an individualized HRTF. Accordingly, the methods as described herein could, theoretically, be used with most existing HRTF estimation techniques to improve performance as the representation contains all of the HRTF information in a smaller number of parameters.

The methods according to embodiments of the present invention and as describe herein further help to avoid over-fitting problems commonly seen when models have a large number of variables. In turn, the methods can help estimation performance generalize better to unseen samples. Additionally, because these individualized coefficients represent spatial variation mainly in the intraconic dimension, the simplification may make it possible to confine acoustic measurements used to estimate the HRTF parameters to the median plane when used in conjunction with an estimation strategy.

The estimation method based shown above based on acoustic measurements is one way to take advantage of the sectoral HRTF model to aid HRTF personalization. However, those of ordinary skill in the art having the benefit of the disclosure herein will readily appreciate that other standard estimation techniques (e.g., multiple regression, neural network, etc.) for fitting parameters may also be employed.

While methods according to one or more embodiments of the present invention are designed to work on a frequency-by-frequency basis, where the number of frequency bins is dictated by the number of Discrete Fourier Transform ("DFT") coefficients describing the HRTF, methods according to other embodiment may utilize DFT representations of any size, and with spectral representations in which individual frequency bins are combined across neighboring frequencies to get wider bands at higher frequencies which would better reflect the auditory system's spectral resolution.

The invention may be used in conjunction with any spatial audio display technology which requires head-related transfer functions to achieve directional positioning of sound sources. In a typical implementation, the embodiments of the invention would be used to efficiently estimate a set of individualized head-related transfer functions in order to provide the audio display user with a more realistic set of spatial auditory cues than what can typically be achieved with non-individualized HRTFs.

While the present invention has been illustrated by a description of one or more embodiments thereof and while these embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the scope of the general inventive concept.

What is claimed is:

1. A system for generating a personalized Head-Related Transfer Function for a listener, wherein the personalized Head-Related Transfer function comprises a listener-specific component and a general component, the system comprising:

a processor that receives the listener-specific component comprising lateral variations in a sample Head-Related Transfer Function; and a database that contains a distribution of known spherical harmonic coefficients derived from a plurality of individuals;

wherein the processor is configured to fit the listener specific component to a spherical harmonic representation and to compare the fitted listener specific component to the known spherical harmonic coefficients in order to estimate the general component; and wherein the processor is configured to generate the personalized Head-Related Transfer Function using the listener specific component and the general component and to apply the personalized Head-Related Transfer Function to a mono-channel sound signal.

2. The system of claim 1, wherein the listener-specific component includes coefficients of a first plurality of spatial basis functions fitting left and right measured frequency-dependent gain parameters of a Head-Related Impulse Response.

3. The system of claim 2, wherein the Head-Related Impulse Response is measured for the listener.

4. The system of claim 3, wherein an intraural timing difference is derived from the measured Head-Related Impulse Response.

5. The system of claim 1, wherein the general component includes coefficients of a second plurality of spatial basis functions fitting left and right measured frequency-dependent gain parameters of a Head-Related Impulse Response.

6. The system of claim 1, wherein the listener-specific, vertical variations of the listener-specific component are estimated from a number of measured HRTFs.

7. The system of claim 6, wherein locations of the number of measured HRTFs are arranged circumferentially, sagittally, coronally, axially, or randomly.

8. The system of claim 7, wherein the locations are along a medial, sagittal plane about the listener.

* * * * *